US010967656B2

(12) United States Patent
Asada et al.

(10) Patent No.: US 10,967,656 B2
(45) Date of Patent: Apr. 6, 2021

(54) SHEET FEED DEVICE

(71) Applicant: BROTHER KOGYO KABUSHIKI KAISHA, Nagoya (JP)

(72) Inventors: Tetsuo Asada, Kuwana (JP); Yoichiro Nishimura, Kitakyushu (JP); Asami Hashimoto, Okazaki (JP); Gakuro Kanazawa, Toyokawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/686,968

(22) Filed: Nov. 18, 2019

(65) Prior Publication Data

US 2020/0171859 A1 Jun. 4, 2020

(30) Foreign Application Priority Data

Nov. 30, 2018 (JP) ..... JP2018-225733

(51) Int. Cl.

| | |
|---|---|
| ***B41J 13/03*** | (2006.01) |
| ***B41J 13/10*** | (2006.01) |
| ***B65H 3/06*** | (2006.01) |
| ***B65H 1/26*** | (2006.01) |
| ***B65H 1/04*** | (2006.01) |

(52) U.S. Cl.

CPC ..... *B41J 13/03* (2013.01); *B41J 13/106* (2013.01); *B65H 1/266* (2013.01); *B65H 1/04* (2013.01); *B65H 3/0669* (2013.01); *B65H 3/0684* (2013.01)

(58) Field of Classification Search

CPC ..... B41J 13/03; B41J 13/106; B65H 3/0684; B65H 3/0669; B65H 1/04; B65H 1/266

USPC ..... 347/101, 104

See application file for complete search history.

(56) References Cited

U.S. PATENT DOCUMENTS

| | | | | |
|---|---|---|---|---|
| 5,292,117 | A * | 3/1994 | Takagi | B41J 11/58 271/127 |
| 5,564,690 | A * | 10/1996 | Oshida | B65H 1/12 271/127 |
| 7,441,767 | B2 * | 10/2008 | Saito | B65H 1/14 271/127 |
| 9,233,807 | B2 * | 1/2016 | Lo | B65H 1/266 |

FOREIGN PATENT DOCUMENTS

| | | |
|---|---|---|
| JP | 2015-123606 A | 7/2015 |

* cited by examiner

*Primary Examiner* — An H Do

(74) *Attorney, Agent, or Firm* — Scully, Scott, Murphy & Presser, PC

(57) ABSTRACT

A front plate is rotatably supported at an end portion of a tray in a pulling direction. The front plate rotatably moves between: a first position at which the front plate extends diagonally upward in the pulling direction from a first end portion at which a rotational axis is located toward a second end portion opposite the first end portion; and a second position at which the second end portion of the front plate is located at a position that is higher than the second end portion at the first position and that is shifted in an insertion direction from the second end portion at the first position. The front plate includes a grip and a surface. The surface of the front plate faces in the pulling direction and downward in a state where the front plate is located at the first position, wherein the surface surrounds the grip.

20 Claims, 11 Drawing Sheets

SHEET FEED DEVICE

CROSS REFERENCE TO RELATED APPLICATIONS

This application claims priority from Japanese Patent Application No. 2018-225733 filed Nov. 30, 2018. The entire content of the priority application is incorporated herein by reference.

TECHNICAL FIELD

This disclosure relates to a sheet feed device configured to convey a sheet.

BACKGROUND

A conventional sheet feed device includes a tray that supports a sheet and conveys the sheet supported on the tray. As an apparatus including such sheet feed device, an image recording apparatus that records an image on a sheet is known, for example.

The tray supports sheets of various sizes. In recent years, the sheet feed device is required to be configured to convey a sheet of a larger size while suppressing an increase in size of the apparatus.

In a known recording apparatus, a cover provided at the front end of the tray is rotatably moved to open. In this recording apparatus, by opening the cover, the tray can support a sheet having a longer front-rear size than the tray.

SUMMARY

According to one aspect, this specification discloses a sheet feed device. The sheet feed device includes a housing and a tray. The housing has an opening and a sheet conveyance path. The tray is configured to be inserted into the housing through the opening in a first direction and to be pulled out from the housing in a second direction opposite from the first direction. The tray is configured to support a sheet. The tray includes a bottom plate and a front plate. The bottom plate is configured to support a sheet. The front plate is rotatably supported at an end portion of the tray in the second direction. The front plate has a first end portion at which a rotational axis of the front plate is located and a second end portion opposite from the first end portion. The front plate is configured to rotatably move between: a first position at which the front plate extends diagonally upward in the second direction from the first end portion toward the second end portion; and a second position at which the second end portion of the front plate is located at a position that is higher than the second end portion at the first position and that is shifted in the first direction from the second end portion at the first position. The front plate includes a grip and a surface. The surface of the front plate faces in the second direction and downward in a state where the front plate is located at the first position, wherein the surface surrounds the grip.

According to another aspect, this specification also discloses a sheet feed device. The sheet feed device includes a housing and a tray. The housing has an opening and a sheet conveyance path. The tray is configured to be inserted into the housing through the opening in a first direction and to be pulled out from the housing in a second direction opposite from the first direction. The tray is configured to support a sheet. The tray includes a bottom plate, a front plate, and a protruding portion. The bottom plate is configured to support a sheet. The front plate is rotatably supported at an end portion of the tray in the second direction. The front plate has a first end portion at which a rotational axis of the front plate is located and a second end portion opposite from the first end portion. The protruding portion protrudes upward from the bottom plate at a position shifted from the front plate in the first direction. The front plate is configured to rotatably move between: a first position at which the front plate extends from the first end portion toward the second end portion in a direction having a component along the second direction; and a second position at which the second end portion of the front plate is located at a position that is higher than the second end portion at the first position. The front plate includes a grip and a surface. The surface of the front plate faces upward in a state where the front plate is located at the first position, wherein the surface surrounds the grip. In a state where the front plate is located at the first position, an upper end of the protruding portion is located at a higher position than an upper end of the grip.

BRIEF DESCRIPTION OF THE DRAWINGS

Embodiments in accordance with this disclosure will be described in detail with reference to the following figures wherein:

FIGS. 4A and 4B are cross-sectional views schematically showing a section A-A of FIG. 3, wherein FIG. 4A shows a state where a front plate 74 is at an standing position and FIG. 4B shows a state where the front plate 74 is at an inclined position;

FIGS. 6A to 6C are cross-sectional views schematically showing a front part of the feed tray 20 as well as a discharge tray 21 of a modification corresponding to the section A-A of FIG. 3, wherein FIG. 6A shows a state where the front plate 74 is at an inclined position, FIG. 6B shows a state where the front plate 74 is at a middle position, and FIG. 6C shows a state where the front plate 74 is at a standing position;

FIGS. 7A and 7B are cross-sectional views schematically showing a part of the feed tray 20 and a discharge tray 21 of a second embodiment corresponding to the section A-A of FIG. 3, wherein FIG. 7A shows a state where the front plate 74 is at a standing position and FIG. 7B shows a state where the front plate 74 is at a lying position;

DETAILED DESCRIPTION

In the above-described recording apparatus, however, when a sheet is supported on the tray in a state where the cover of the tray is open, the sheet is placed on the cover. This makes it difficult for a user to put his or her finger on the cover to insert the tray into the recording apparatus or remove the tray from the recording apparatus.

In view of the foregoing, an aspect of an object of this disclosure is to provide a sheet feed device in which it is easy to put a finger on a cover of a tray in a state where a sheet having a longer front-rear size than the tray is supported on the tray.

Some aspects of this disclosure will be described while referring to the attached drawings. In the following description, an upper-lower direction Z is defined in a state where an MFP (multifunction peripheral) 10 is placed in an orientation in which it is intended to be used (the state of FIG. 1), a front-rear direction Y is defined by defining a surface formed with an opening 13 as a front surface 22, and a left-right direction X (an example of a width direction) is defined in a state where the MFP 10 is viewed from the front. The upper-lower direction Z, the front-rear direction Y, and the left-right direction X are perpendicular to each other.

First Embodiment

Hereinafter, a first embodiment will be described while referring to FIGS. 1 to 5.

[Overall Structure of MFP 10]

Figure 1:
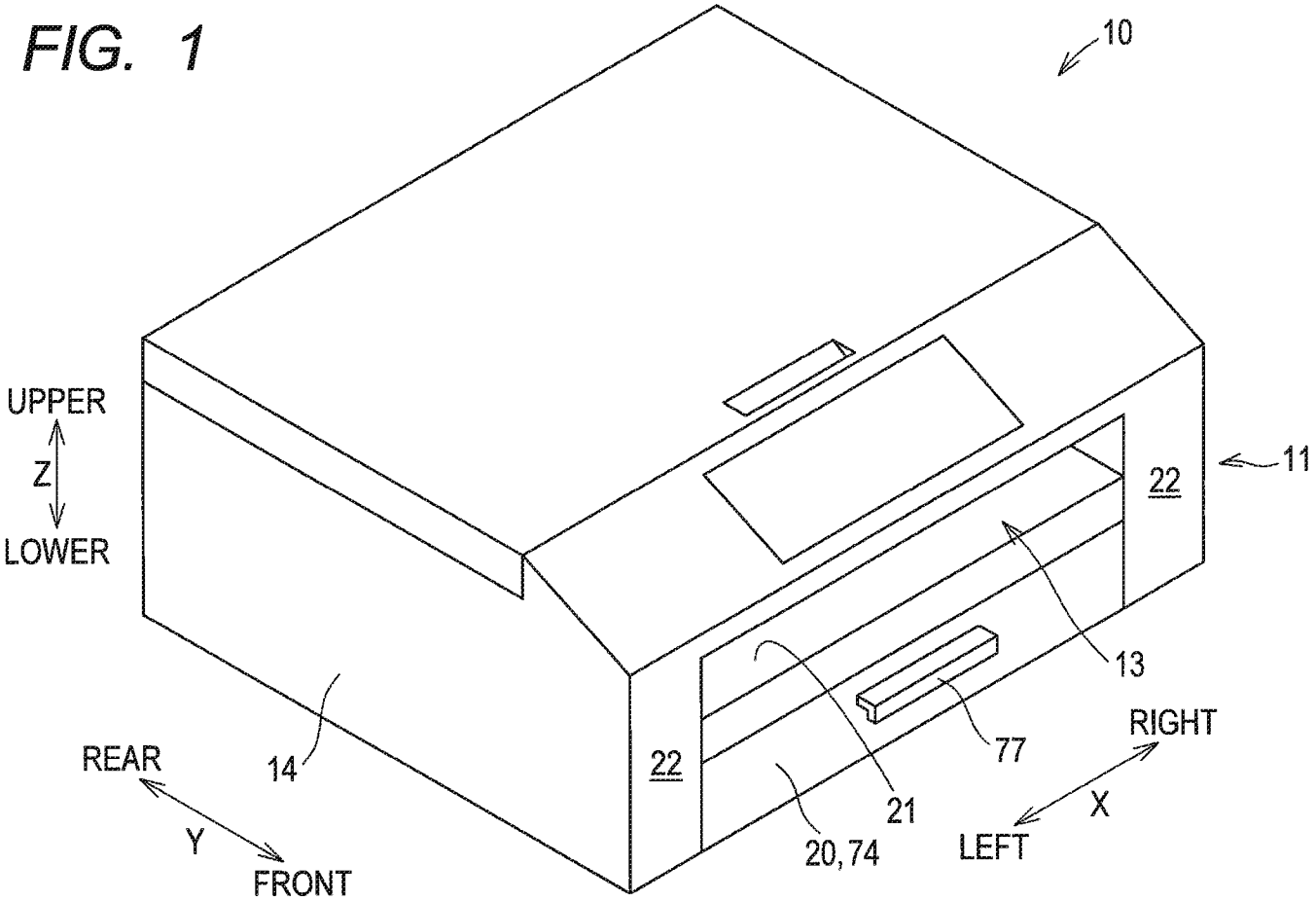
FIG. 1 is a perspective view of an MFP 10.

As shown in FIG. 1, the MFP 10 (an example of an image recording apparatus) is substantially formed as a thin rectangular parallelepiped.

The MFP 10 includes a printer unit 11 at a lower part thereof. The printer unit 11 records an image on paper 15 (an example of a sheet, see FIG. 2). The printer unit 11 includes a sheet feed device and a recording unit 24.

Figure 2:
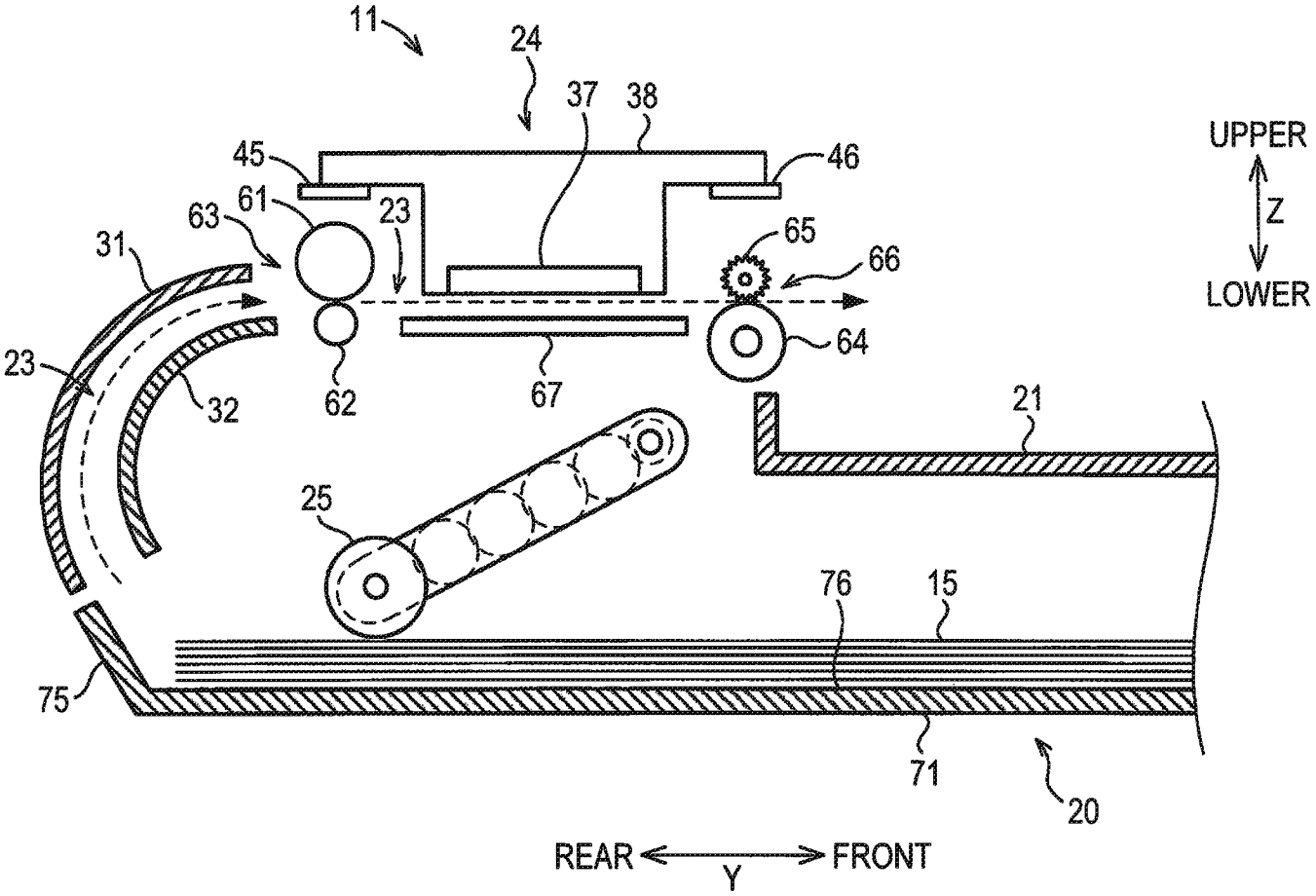
FIG. 2 is a vertical cross-sectional view schematically showing the internal structure of a printer unit 11.

The sheet feed device includes a housing 14 shown in FIG. 1, a feed tray 20 (an example of a tray) shown in FIG. 2, a discharge tray 21, a feed roller 25, a pair of conveyance rollers 63, and a pair of discharge rollers 66.

The housing 14 has substantially a rectangular-parallelepiped box shape. The housing 14 has an internal space. As shown in FIG. 2, a conveyance path 23 is formed in the internal space of the housing 14. The feed roller 25, the pair of conveyance rollers 63, the pair of discharge rollers 66, the recording unit 24, and so on are arranged in the internal space of the housing 14.

The conveyance path 23 is a path through which paper 15 passes. The feed roller 25 feeds, to the conveyance path 23, paper 15 supported on an upper surface 76 (an example of a sheet support surface) of a bottom plate 71 of the feed tray 20. The feed roller 25 is driven by receiving driving force of a feed motor (not shown). The pair of conveyance rollers 63 and the pair of discharge rollers 66 are arranged on the conveyance path 23. The pair of conveyance rollers 63 and the pair of discharge rollers 66 convey paper 15 that is fed to the conveyance path 23 by the feed roller 25. The recording unit 24 records an image on paper 15 by an inkjet method.

As shown in FIG. 1, the opening 13 is formed in the front surface 22 of the housing 14. The feed tray 20 is configured to be inserted rearward into the housing 14 through the opening 13 and mounted onto the housing 14. The feed tray 20 is configured to be pulled out forward from the housing 14 through the opening 13. The rearward direction is an example of a first direction, and the forward direction is an example of a second direction.

In the first embodiment, the feed tray 20 is configured to be removed from the housing 14. Here, the feed tray 20 may be configured not to be removed from the housing 14 (more specifically, the feed tray 20 can be pulled to a particular position but cannot be pulled farther than that position).

As shown in FIG. 2, the feed tray 20 supports paper 15 of a desired size. FIGS. 1 and 2 show a state where the feed tray 20 is mounted on the housing 14. The detailed configuration of the feed tray 20 will be described later.

The discharge tray 21 is located above the feed tray 20. The discharge tray 21 supports paper 15 on which an image is recorded and that is discharged from the housing 14. The discharge tray 21 is supported by the housing 14. The discharge tray 21 may be supported by the feed tray 20 and may be configured to move together with the feed tray 20.

[Conveyance Path 23]

As shown in FIG. 2, the conveyance path 23 is a path that starts from a rear end portion of the feed tray 20 mounted on the housing 14, extends upward from below while making a U-turn, extends forward to pass below the recording unit 24, and reaches the discharge tray 21. The conveyance path 23 is a space formed by a first guide member 31 and a second guide member 32 facing each other with a particular interval, the pair of conveyance rollers 63, the recording unit 24 and a platen 67 facing each other with a particular interval, and the pair of discharge rollers 66. The paper 15 fed by the feed roller 25 is conveyed through the conveyance path 23 in a conveyance direction that is indicated by the dashed arrow in FIG. 2.

[Pair of Conveyance Rollers 63 and Pair of Discharge Rollers 66]

As shown in FIG. 2, the pair of conveyance rollers 63 is arranged on the conveyance path 23. The pair of conveyance rollers 63 includes a conveyance roller 61 and a pinch roller 62. The pinch roller 62 is in pressure contact with the conveyance roller 61 due to an elastic member such as a spring (not shown). With this configuration, the pair of conveyance rollers 63 is configured to nippingly hold paper 15.

The pair of discharge rollers 66 is arranged at the downstream side of the pair of conveyance rollers 63 in the conveyance direction along the conveyance path 23. The pair of discharge rollers 66 includes a discharge roller 64 and a spur 65. The spur 65 is in pressure contact with the discharge roller 64 due to an elastic member such as a spring (not shown). With this configuration, the pair of discharge rollers 66 is configured to nippingly hold paper 15.

The conveyance roller 61 and the discharge roller 64 are driven by receiving driving force of a conveyance motor (not shown). The conveyance roller 61 to which driving force is transmitted nippingly holds paper 15 with the pinch roller 62 therebetween and conveys the paper 15 in the conveyance direction. The discharge roller 64 to which driving force is transmitted nippingly holds paper 15 with the spur 65 therebetween and conveys the paper 15 in the conveyance direction.

[Recording Unit 24]

As shown in FIG. 2, the recording unit 24 is disposed between the pair of conveyance rollers 63 and the pair of discharge rollers 66 on the conveyance path 23. The recording unit 24 includes a recording head 37 and a carriage 38. The recording head 37 ejects ink droplets by an inkjet method. The recording head 37 is mounted on the carriage 38. The carriage 38 is supported by guide rails 45 and 46 so as to move along the left-right direction X perpendicular to the conveyance direction of paper 15. The guide rails 45 and 46 are supported by the housing 14. The carriage 38 moves by receiving driving force of a carriage drive motor (not shown).

The recording head 37 is disposed at a lower part of the carriage 38. The lower surface of the recording head 37 is formed with a plurality of nozzles (not shown). The nozzles are exposed on the lower surface of the carriage 38. The nozzles eject ink droplets toward the platen 67 located below. The platen 67 is disposed below the recording head 37 so as to face the recording head 37. The platen 67 has substantially a flat plate shape, and is configured to support paper 15 on the upper surface thereof.

In the housing 14, ink tanks of each color (for example, black, yellow, cyan, and magenta) (not shown) are arranged. The ink tanks may be mounted on the carriage 38. Ink of each color is supplied from the ink tanks to the recording head 37. While the carriage 38 moves along the left-right direction X, ink of each color is selectively ejected from each nozzle as small ink droplets. With this configuration, an image is recorded on paper 15 located on the platen 67.

[Feed Tray 20]

Figure 3:
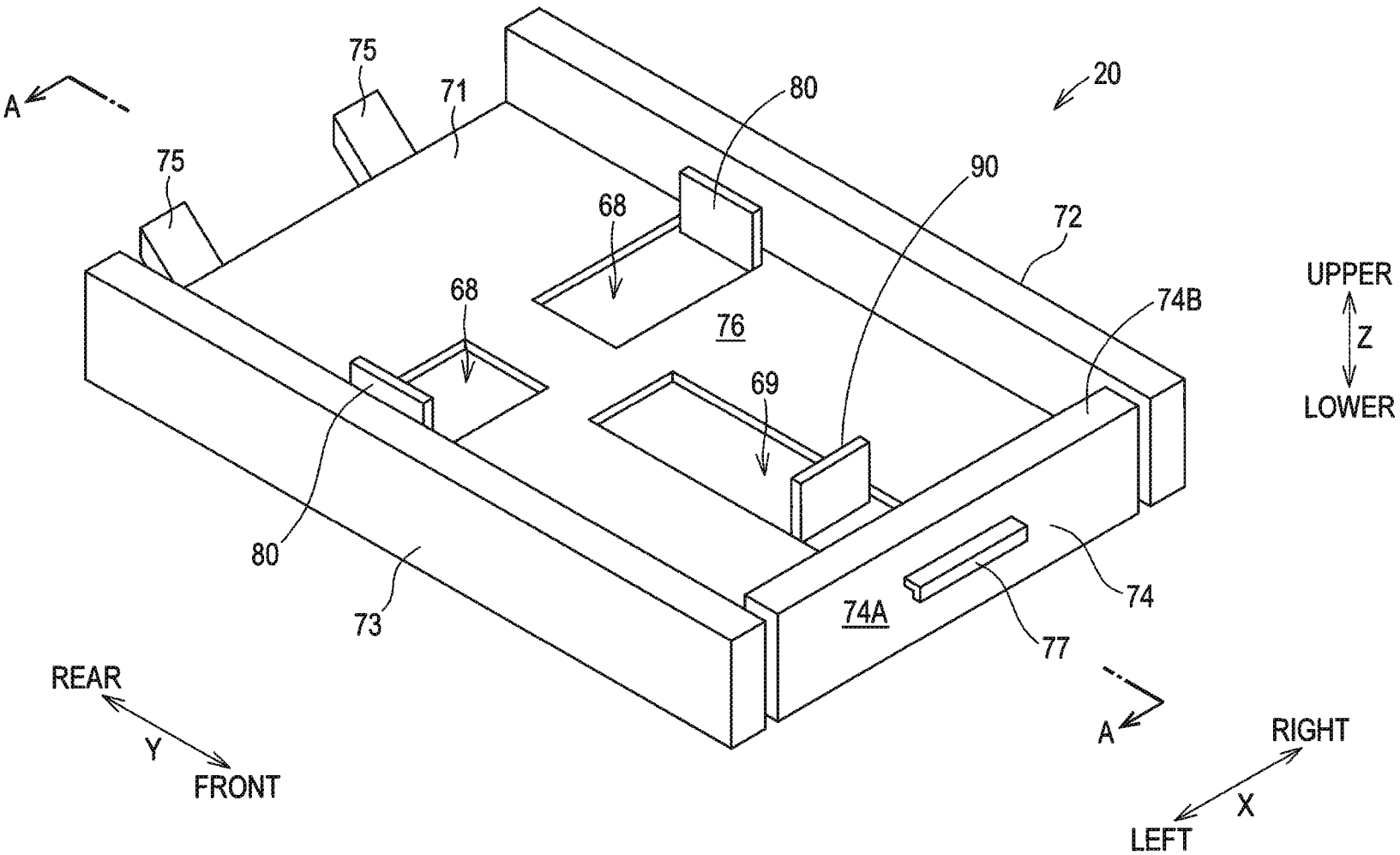
FIG. 3 is a perspective view of a feed tray 20.

As shown in FIG. 3, the feed tray 20 has substantially a rectangular-parallelepiped box shape. The upper side of the feed tray 20 is opened. The length of the feed tray 20 in the upper-lower direction Z is shorter than the length of the feed tray 20 in the left-right direction X and the length of the feed tray 20 in the front-rear direction Y. The feed tray 20 includes the bottom plate 71, side plates (a right plate 72, a left plate 73, and a front plate 74), and stoppers 75.

The bottom plate 71 has the upper surface 76 on which paper 15 is supported. The upper surface 76 is a surface extending in the front-rear direction Y and in the left-right direction X.

The right plate 72 is provided to stand at the right end portion of the bottom plate 71. The right plate 72 extends in the front-rear direction Y. The left plate 73 is provided to stand at the left end portion of the bottom plate 71. The left plate 73 extends in the front-rear direction Y. The right plate 72 and the left plate 73 face each other in the left-right direction X. The right plate 72 and the left plate 73 are an example of a pair of side plates.

The front plate 74 is located at the front end portion of the bottom plate 71. The front plate 74 extends in the left-right direction X. The front plate 74 is rotatably supported by the front end portion of the right plate 72 and by the front end portion of the left plate 73. Alternatively, the front plate 74 may be rotatably supported by the front end portion of the bottom plate 71, or may be rotatably supported by another member at a position adjacent to the front end portion of the bottom plate 71. The configuration of the front plate 74 will be described later in detail.

The stoppers 75 are provided to extend diagonally rearward from the rear end portion of the bottom plate 71. At least one (two in the first embodiment) stopper 75 is arranged with intervals therebetween in the left-right direction X. The stoppers 75 are configured to contact the rear end of paper 15 (the leading end of paper 15 when the paper 15 is conveyed) having a size that is set as a supportable size on the upper surface 76 in the MFP 10. With this configuration, in a state where the feed tray 20 is removed through the opening 13, the stoppers 75 stop rearward movement of paper 15 supported on the upper surface 76. This prevents the paper 15 from dropping from the rear end of the feed tray 20.

A pair of side guides 80 is supported at the upper surface 76 of the bottom plate 71 so as to be movable in the left-right direction X. The pair of side guides 80 protrudes upward from the upper surface 76. Each of the pair of side guides 80 is configured to move along a groove 68 formed in the upper surface 76. The pair of side guides 80 is arranged to face each other in the left-right direction X. Both of left and right ends of paper 15 supported on the upper surface 76 contact the side surface of each of the pair of side guides 80. When one of the pair of side guides 80 moves rightward or leftward, the other one of the pair of side guides 80 interlockingly moves in the opposite direction of rightward or leftward. With this configuration, paper 15 is positioned in the center of the upper surface 76 in the left-right direction X.

Regarding the configuration by which the pair of side guides 80 is movably supported by the bottom plate 71, a known configuration may be adopted. Further, only one side guide may be provided instead of the pair of side guides 80. In this case, the side guide contacts the right end or the left end of paper 15 supported on the upper surface 76 to position the paper 15 to the left end or the right end.

A rear guide 90 (an example of a protruding portion) is supported on the upper surface 76 of the bottom plate 71 so as to be movable in the front-rear direction Y. The rear guide 90 protrudes upward from the upper surface 76. The rear guide 90 is located at a farther rearward than the front plate 74. In the first embodiment, the rear guide 90 is located at the center portion of the upper surface 76 in the left-right direction X, but may be located at a position other than the center portion. The rear guide 90 is configured to move along a groove 69 formed in the upper surface 76. The rear guide 90 contacts the front end of paper 15 (the trailing end of paper 15 when the paper 15 is conveyed) supported on the upper surface 76. With this configuration, the front end of paper 15 is positioned. Regarding the configuration by which the rear guide 90 is movably supported by the bottom plate 71, a known configuration may be adopted.

Figure 10A:
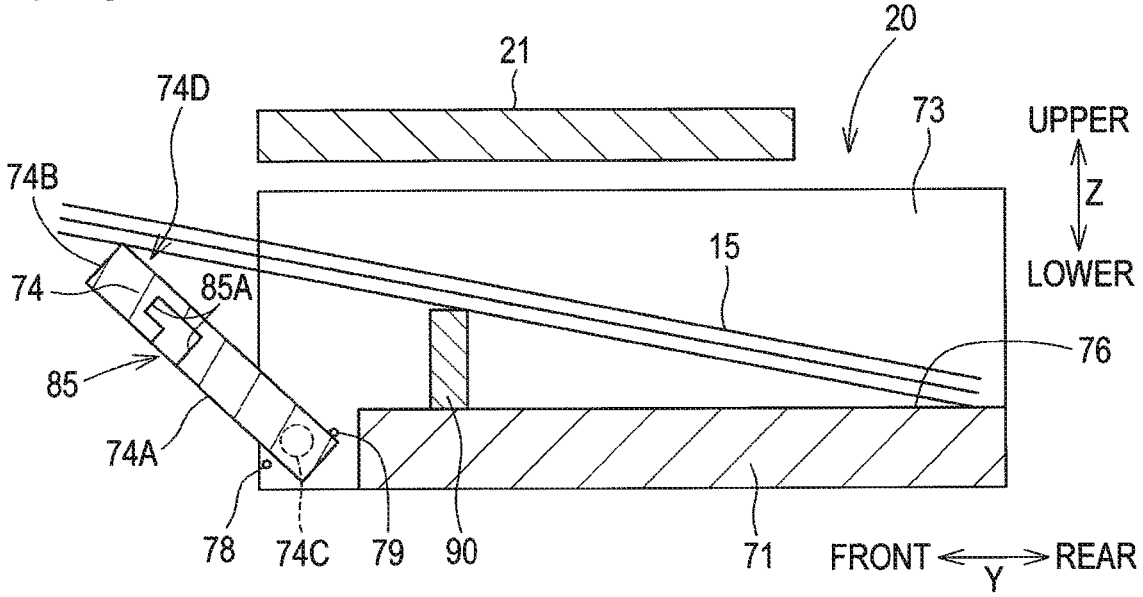
FIG. 10A is a cross-sectional view schematically showing a part of the feed tray 20 having a concave portion 85 and the discharge tray 21 corresponding to the section A-A of FIG. 3 in a state where the front plate 74 is at an inclined position.
Figure 10B:
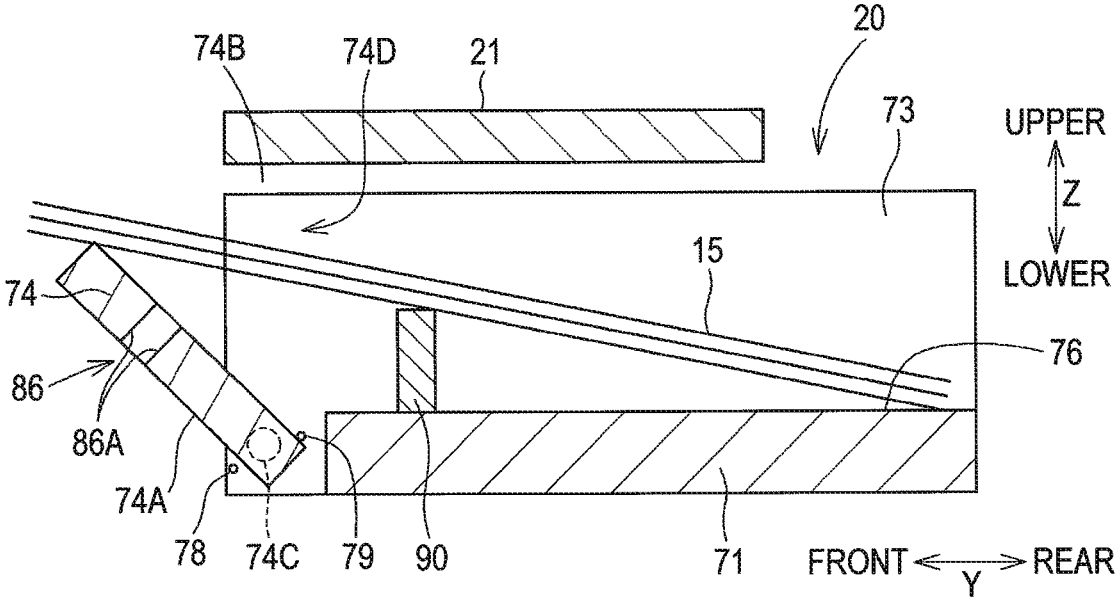
FIG. 10B is a cross-sectional view schematically showing a part of the feed tray 20 having a through hole 86 and the discharge tray 21 corresponding to the section A-A of FIG. 3 in a state where the front plate 74 is at an inclined position.

The front plate 74 includes a grip portion 77 at a front surface 74A thereof. The grip portion 77 is gripped by accessing the front plate 74 from the front side when the front plate 74 is rotatably moved and when the feed tray 20 is inserted into and removed from the housing 14. The grip portion 77 is accessible from the front side of the front plate 74. In the first embodiment, the grip portion 77 is a protrusion that protrudes from the front surface 74A. In the first embodiment, the grip portion 77 is located at the center portion of the front surface 74A in the left-right direction X, but may be located at a position other than the center portion. Alternatively, as shown in FIG. 10A, instead of the protrusion, a concave portion 85 that is concaved rearward may be formed in the front surface 74A. In this case, each surface 85A constituting (defining) the concave portion 85 serves as the grip. Alternatively, instead of the protrusion, a through hole 86 penetrating the front plate 74 in the front-rear direction Y may be formed in the front plate 74. In this case, each surface 86A constituting (defining) the through hole 86 serves as the grip. Each of the grip portion 77, the surface 85A defining the concave portion 85, and the surface 86A defining the through hole 86 is an example of a grip.

Figure 5:
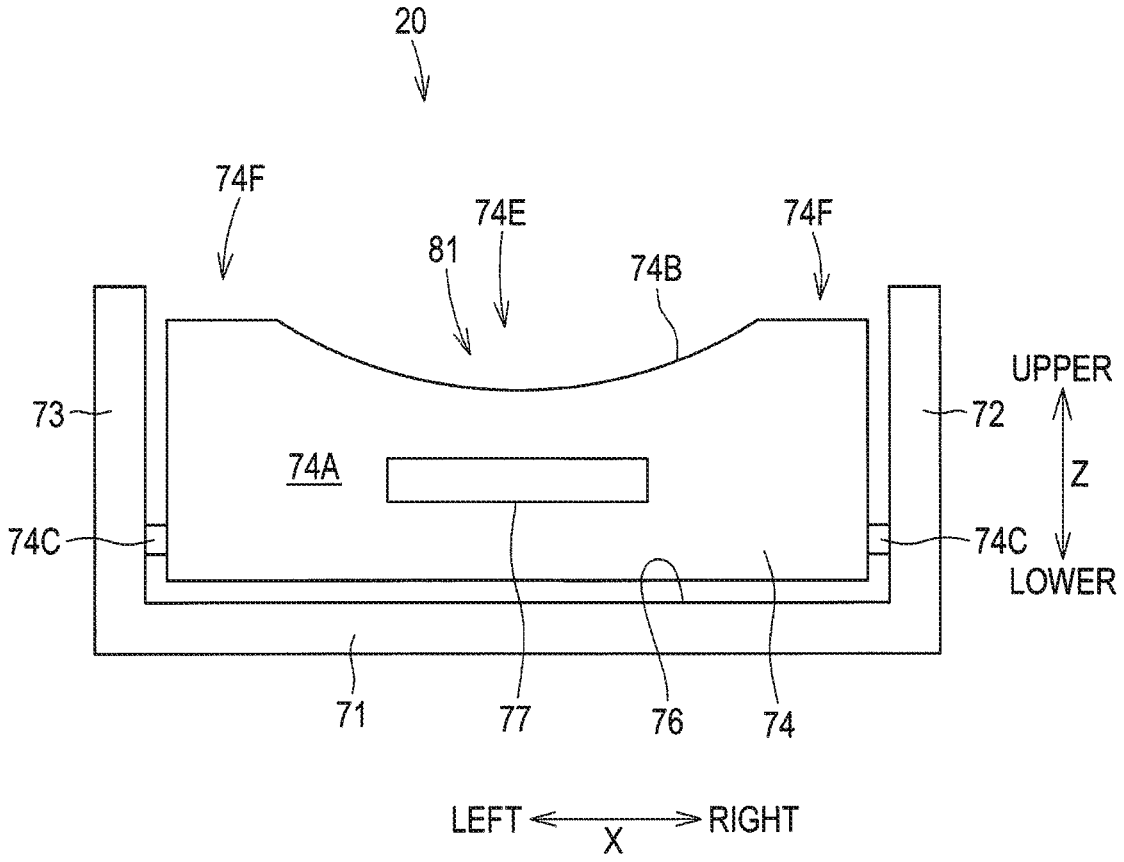
FIG. 5 is a front view of the feed tray 20.

As shown in FIG. 5, the front plate 74 includes a concave portion 81 at a center portion 74E of the upper surface 74B in the left-right direction X. With this configuration, the center portion 74E of the upper surface 74B in the left-right direction X is located at a lower position than both end portions 74F of the upper surface 74B in the left-right direction X. Here, a configuration other than the concave portion 81 may be adopted for realizing the configuration in which the center portion 74E of the upper surface 74B in the left-right direction X is located at a lower position than the both end portions 74F of the upper surface 74B in the left-right direction X. For example, instead of including the concave portion 81, the front plate 74 may include protrusions that protrude upward from the both end portions 74F of the upper surface 74B in the left-right direction X.

The front plate 74 includes protrusions 74C that protrude from the lower end portions of the right surface and the left surface in the left-right direction X. The protrusions 74C are inserted in holes (not shown) formed in the right plate 72 and the left plate 73. With this configuration, as described above, the front plate 74 is rotatably supported by the front end portion of the right plate 72 and the front end portion of the left plate 73. Alternatively, the front plate 74 may be rotatably supported at the front end portion of the bottom plate 71.

Figure 4A:
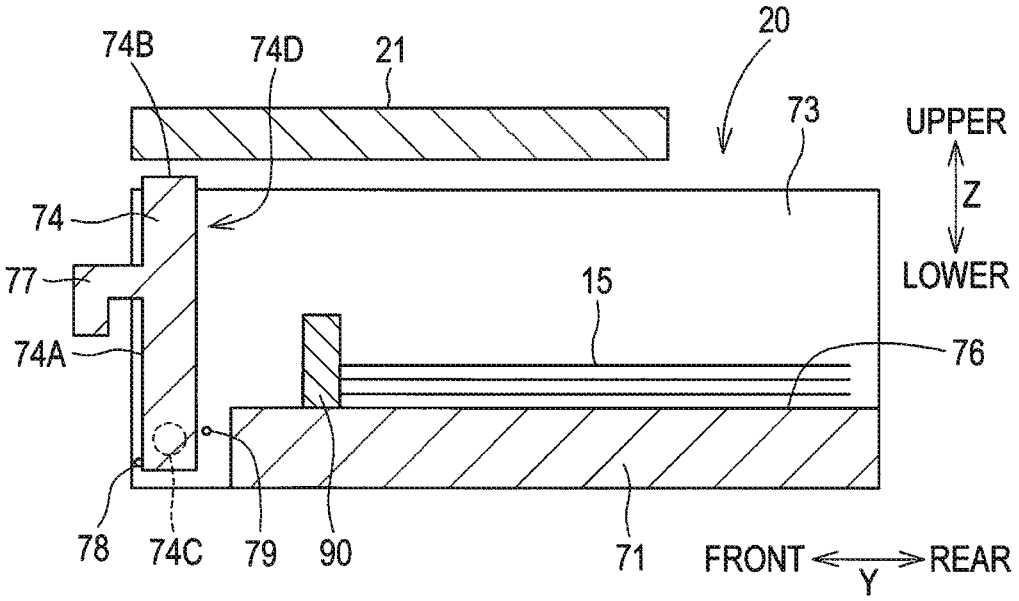
Figure 4B:
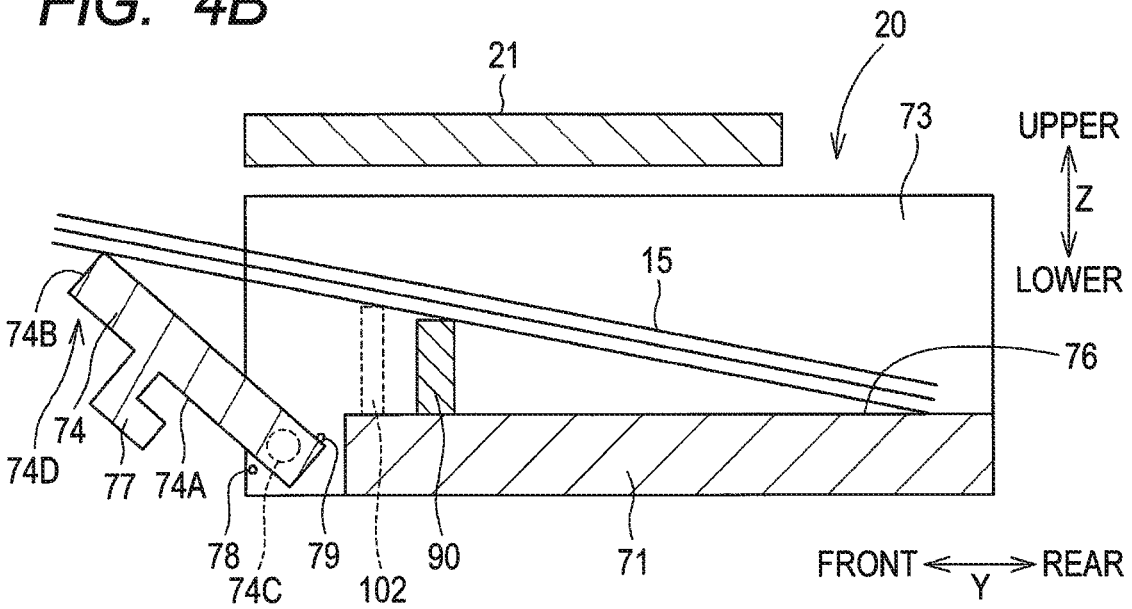

The front plate 74 is configured to rotatably move between a standing position shown in FIGS. 1, 3, and 4A (an example of a second position) and an inclined position shown in FIG. 4B (an example of a first position).

As shown in FIG. 4A, in a state where the front plate 74 is located at the standing position, the front plate 74 extends upward (vertically) from the front end portion of the bottom plate 71. In a state where the front plate 74 is located at the standing position, the surface 74A extends in the upper-lower direction Z and in the left-right direction X and faces forward.

As shown in FIG. 4B, in a state where the front plate 74 is located at the inclined position, the front plate 74 extends diagonally forward and upward from the front end portion of the bottom plate 71, and is inclined relative to the bottom plate 71. In a state where the front plate 74 is located at the inclined position, the surface 74A faces forward and downward. A gap (space) is formed between the surface 74A and a placement surface on which the feed tray 20 is placed. Hence, in a state where the front plate 74 is located at the inclined position, the grip portion 77 can be gripped easily. A distal end portion 74D of the front plate 74 at the standing position (see FIG. 4A) is located a farther rearward and upward position than the distal end portion 74D of the front plate 74 at the inclined position (see FIG. 4B).

Protrusions 78, 79 protruding in the left-right direction X are formed at the left surface of the right plate 72 and the right surface of the left plate 73. As shown in FIG. 4A, the protrusion 78 contacts the front plate 74 at the standing position to prevent the front plate 74 at the standing position from rotatably moving clockwise in FIG. 4A (in other words, prevents the front plate 74 at the standing position from rotatably moving in the direction away from the inclined position). As shown in FIG. 4B, the protrusion 79 contacts the front plate 74 at the inclined position to prevent the front plate 74 at the inclined position from rotatably moving counter-clockwise in FIG. 4B (in other words, prevents the front plate 74 at the inclined position from rotatably moving in the direction away from the standing position).

In addition to the above-described configuration, known configurations may be adopted as the configuration in which the front plate 74 is rotatably supported and the configuration in which rotational movement of the front plate 74 is restricted at the standing position and at the inclined position. For example, the configuration of rotatably supporting the front plate 74 may be any member constituting the feed tray 20, and may be provided at the bottom plate 71 instead of the right plate 72 and the left plate 73.

As shown in FIG. 2, in a state where the feed tray 20 is inserted into the housing 14 through the opening 13 and is mounted on the housing 14, paper 15 supported on the feed tray 20 can be fed to the conveyance path 23.

In a state where a part or an entirety of the feed tray 20 is pulled out from the housing 14 through the opening 13 (for example, as shown in FIG. 3, a state where the entirety of the feed tray 20 is pulled out), paper 15 can be replenished onto the feed tray 20. Even when the feed tray 20 is not pulled out from the housing 14, as shown in FIG. 4B, paper 15 can be replenished onto the feed tray 20 by rotatably moving the front plate 74 to the inclined position.

As shown in FIG. 4A, in a case where paper 15 having a shorter length than the upper surface 76 in the front-rear direction Y is supported on the upper surface 76, paper 15 is positioned by the rear guide 90. In this case, the front plate 74 is located at the standing position. This suppresses entrance of a foreign matter to inside the feed tray 20 from the outside.

As shown in FIG. 4B, in a case where paper 15 having a longer length than the upper surface 76 in the front-rear direction Y is supported on the upper surface 76, the front plate 74 is located at the inclined position. In this case, the rear portion of paper 15 is supported on the upper surface 76, and the front portion of paper 15 is supported on the rear guide 90 and the upper surface 74B of the front plate 74. At this time, the front portion of paper 15 is supported along the concave portion 81 (FIG. 5) of the upper surface 74B of the front plate 74, and thereby becomes convex downward with respect to the left-right direction X. This suppresses hanging down of a part of paper 15 located farther forward than the front plate 74.

[Effects of First Embodiment]

In the first embodiment, in a case where paper 15 having a longer length than the bottom plate 71 in the front-rear direction Y is supported on the bottom plate 71, the front plate 74 is rotatably moved to the inclined position. With this configuration, because the distal end portion 74D of the front plate 74 is located at a lower position than the distal end portion 74D at the standing position, the gap (space) above the distal end portion 74D (the gap between the discharge tray 21 and the distal end portion 74D in the first embodiment) can be increased. That is, the gap between the housing 14 (specifically, the surface defining the opening) and the upper end of the front plate 74 can be increased. And, paper 15 having a longer front-rear length than the bottom plate 71 can be supported on the bottom plate 71 through the gap.

In the first embodiment, the front plate 74 at the inclined position extends diagonally upward from the bottom plate 71. Thus, when the front plate 74 is at the inclined position, the grip portion 77 formed at the front plate 74 is exposed to the outside the sheet feed device. Hence, the feed tray 20 can be moved easily by gripping the grip portion 77. That is, even in a state where paper 15 having a longer front-rear length than the bottom plate 71 is supported on the feed tray 20, it is easy to put a hand (or fingers) on the grip portion 77 (the concave portion 85, the through hole 86) of the feed tray 20.

In a state where the front plate 74 is rotatably moved to the inclined position and paper 15 having a longer front-rear length than the bottom plate 71 is supported on the bottom plate 71, the paper 15 is supported on the upper surface 74B of the front plate 74. In the first embodiment, the both end portions 74F of the upper surface 74B of the front plate 74 in the left-right direction X are located at a higher position than the center portion 74E. Hence, the paper 15 supported on the upper surface 74B of the front plate 74 becomes a curved state that is convex downward. This suppresses hanging down of paper 15. This reduces a possibility that the grip portion 77 is covered by paper 15 that hangs down.

In the first embodiment, because paper 15 having a longer front-rear length than the bottom plate 71 is supported by the rear guide 90, the paper 15 supported on the bottom plate 71 can be located at a higher position. Thus, in a state where paper 15 having a longer front-rear length than the bottom plate 71 is supported the bottom plate 71, the paper 15 is supported on the bottom plate 71, the rear guide 90, and the upper surface 74B of the front plate 74 in this order from the rear toward the front. Thus, paper 15 can be supported in a natural posture that is gradually upward toward the front.

[Modification of First Embodiment]

Figure 6A:
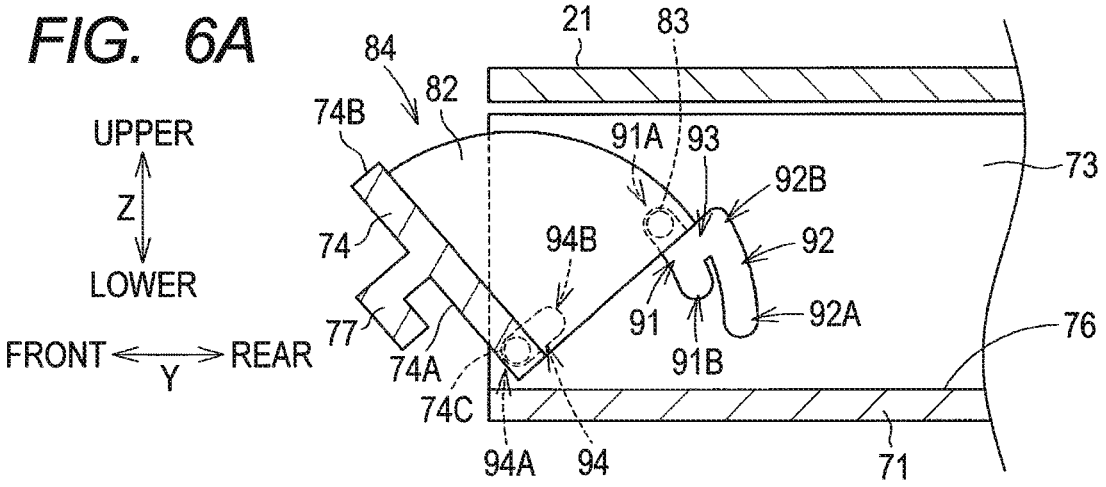
Figure 6B:
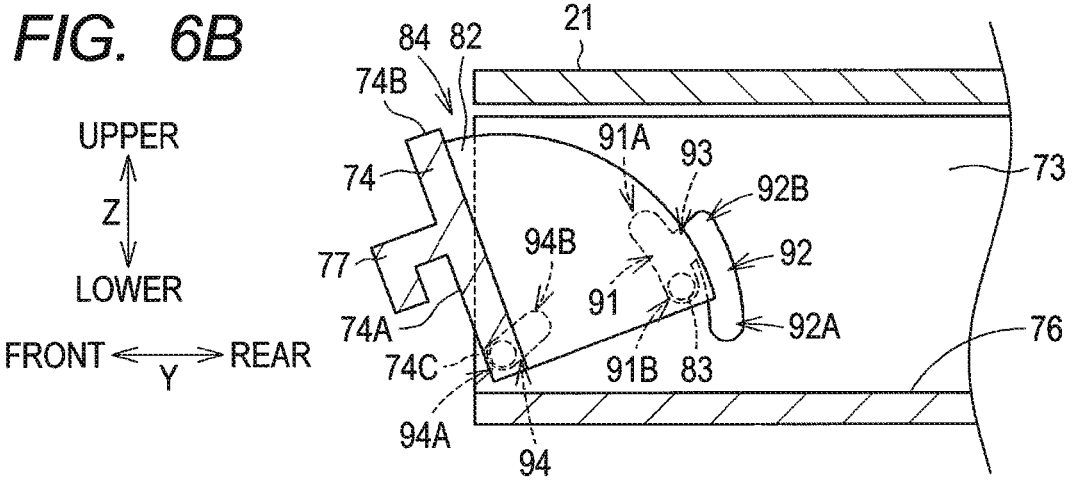
Figure 6C:
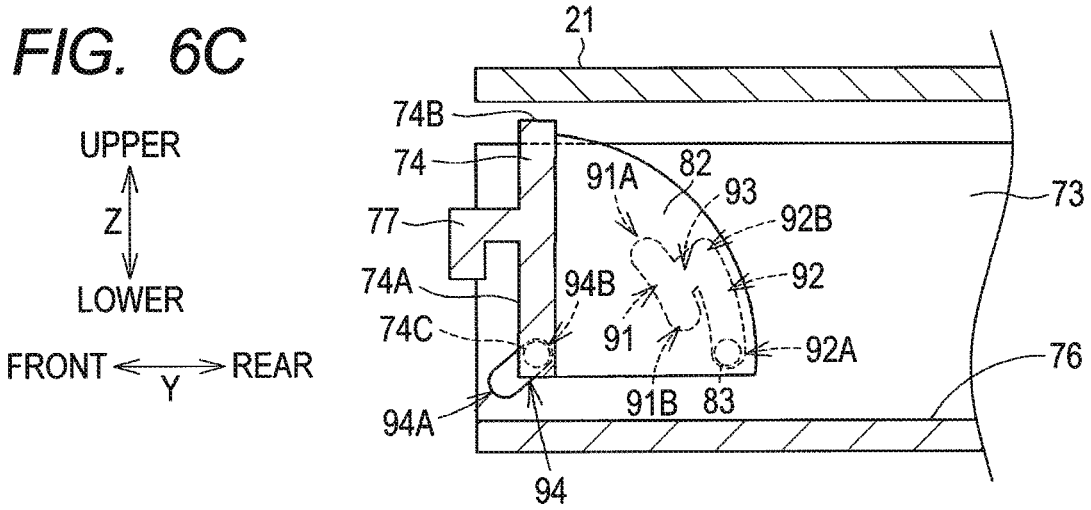

In addition to the standing position and the inclined position, the front plate 74 may be configured to stop at a middle position (an example of a third position) between the standing position and the inclined position. For example, the feed tray 20 may be configured as shown in FIGS. 6A to 6C. The details will be described below.

Each of the right plate 72 and the left plate 73 includes a first groove 91, a second groove 92, a third groove 93, and a fourth groove 94.

The first groove 91 extends in an arc shape about the protrusion 74C located at the position shown in FIGS. 6A and 6B as the center of the arc. One end 91A of the first groove 91 is located at a higher position than an other end 91B of the first groove 91. The second groove 92 extends in an arc shape about the protrusion 74C at the position shown in FIG. 6C as the center of the arc. One end 92A of the second groove 92 is located at a lower position than an other end 92B of the second groove 92. The third groove 93 connects the first groove 91 with the second groove 92. One end of the third groove 93 is connected to a part between the one end 91A and the other end 91B of the first groove 91. The other end of the third groove 93 is connected to the other end 92B of the second groove 92.

The fourth groove 94 is located at a farther forward position than the first groove 91, the second groove 92, and the third groove 93. The fourth groove 94 extends diagonally upward toward the rear. The protrusion 74C of the front plate 74 is inserted in the fourth groove 94, and is guided along the fourth groove 94.

Side plates 82 extend rearward from both end portions of the front plate 74 in the left-right direction X. Each side plate 82 includes a protrusion 83. The side plate 82 extending from the right end portion of the front plate 74 faces the right plate 72 in the left-right direction X, and the side plate 82 extending from the left end portion of the front plate 74 faces the left plate 73 in the left-right direction X. The protrusion 83 of the side plate 82 extending from the right end portion of the front plate 74 protrudes rightward toward the right plate 72. The protrusion 83 of the side plate 82 extending from the left end portion of the front plate 74 protrudes leftward toward the left plate 73. The protrusion 83 is inserted in the first groove 91, the second groove 92, and the third groove 93, and is guided along the first groove 91, the second groove 92, and the third groove 93.

Hereinafter, rotational movement of the front plate 74 shown in FIGS. 6A to 6C will be described. As shown in FIG. 6A, when the front plate 74 is located at the inclined position, the protrusion 74C is located at one end 94A of the fourth groove 94, and the protrusion 83 is located at the one end 91A of the first groove 91. The protrusion 83 is located at the one end 91A of the first groove 91, which prevents the front plate 74 at the inclined position from rotatably moving counter-clockwise in FIG. 6A (in other words, prevents the front plate 74 at the inclined position from rotatably moving in the direction away from the middle position).

The user who grips the grip portion 77 pushes the front plate 74 rearward, and thereby the protrusion 83 is guided from the one end 91A toward the other end 91B of the first groove 91. With this operation, the front plate 74 rotatably moves clockwise in FIG. 6A about the protrusions 74C as the center.

As shown in FIG. 6B, when the protrusion 83 is located at the other end 91B of the first groove 91, the front plate 74 is located at the middle position. When the front plate 74 is located at the middle position, the protrusion 74C is located at the one end 94A of the fourth groove 94. The protrusion 83 is located at the other end 91B of the first groove 91, which prevents the front plate 74 at the middle position from rotatably moving clockwise in FIG. 6B (in other words, prevents the front plate 74 at the middle position from rotatably moving in the direction away from the inclined position).

As described above, when the front plate 74 at the inclined position is pushed rearward, the front plate 74 stops at the middle position. Hence, a gap 84 between the front plate 74 and the discharge tray 21 is kept wide. With this configuration, as in the case of FIG. 4B, paper 15 having a large size can be supported through the gap 84.

The movement of the front plate 74 from the middle position to the inclined position is performed oppositely from the above-described movement from the inclined position to the middle position.

In order to move the front plate 74 at the inclined position to the standing position, first, in a similar manner to the above, the user who grips the grip portion 77 pushes the front plate 74 at the inclined position rearward, and thereby the front plate 74 rotatably moves clockwise shown in FIG. 6A about the protrusions 74C as the center. In the middle of this rotational movement (in a state where the protrusion 83 is located between the one end 91A and the other end 91B of the first groove 91), the user holds up the front plate 74 while pushing the front plate 74 rearward. With this operation, the protrusion 74C is guided from the one end 94A to an other end 94B of the fourth groove 94. Further, the protrusion 83 is guided rearward and upward along the third groove 93, and reaches the other end 92B of the second groove 92. After that, due to force by which the front plate 74 is pushed rearward, the protrusion 83 is guided from the other end 92B to the one end 92A of the second groove 92. With this operation, the front plate 74 rotatably moves clockwise in FIG. 6C about the protrusions 74C located at the other end 94B of the fourth groove 94 as the center. As a result of that, as shown in FIG. 6C, the front plate 74 rotatably moves the standing position.

As shown in FIG. 6C, when the front plate 74 is located at the standing position, the protrusion 74C is located at the other end 94B of the fourth groove 94, and the protrusion 83 is located at the one end 92A of the second groove 92.

The movement of the front plate 74 from the standing position to the inclined position is performed oppositely from the above-described movement from the inclined position to the standing position of the front plate 74.

In order to move the front plate 74 from the middle position to the standing position, first, the user who grips the grip portion 77 pulls the front plate 74 at the middle position forward so as to rotatably move the front plate 74 counter-clockwise in FIG. 6B, so that the protrusion 83 is located between the one end 91A and the other end 91B of the first groove 91. The operation after that is similar to the movement of the front plate 74 from the inclined position to the standing position. The movement of the front plate 74 from the standing position to the middle position is performed oppositely from the above-described movement from the middle position to the standing position of the front plate 74.

When the grip portion 77 is gripped and the feed tray 20 is inserted into the housing 14 in a state where paper 15 having a longer front-rear length than the bottom plate 71 is supported on the bottom plate 71, if force in the rearward direction acts on the front plate 74 and the front plate 74 rotatably moves from the inclined position to the standing position, the gap above the front plate 74 (in the configuration shown in FIGS. 6A to 6C, the gap between the discharge tray 21 and the front plate 74) becomes narrow and paper 15 is sandwiched between the discharge tray 21 and the front plate 74. In the configuration shown in FIGS. 6A to 6C, even if the front plate 74 is rotatably moved toward the standing position when the feed tray 20 is inserted into the housing 14, the protrusion 83 contacts the other end 91B of the first groove 91 and thereby the front plate 74 is stopped at the middle position. This configuration reduces a possibility that paper 15 is sandwiched between the discharge tray 21 and the front plate 74.

In the configuration shown in FIGS. 6A to 6C, the front plate 74 is rotatably moved to the standing position by moving the protrusion 83 from the first groove 91 through the third groove 93 to the second groove 92.

In the configuration shown in FIGS. 6A to 6C, the operation of stopping the rotational movement of the front plate 74 at the middle position as described above is realized by a simple configuration of only grooves and the protrusion 83 without providing a complicated mechanism for holding the front plate 74 at the middle position.

In contrast to the configuration shown in FIGS. 6A to 6C, the first groove 91, the second groove 92, and the third groove 93 may be provided at the side plate 82, and the protrusion 83 may be provided at the right plate 72 and the left plate 73. Further, the fourth groove 94 may be provided at the front plate 74, and the protrusion 74C may be provided at the right plate 72 and the left plate 73.

Further, the configuration in which the front plate 74 is stopped at the middle position in addition to the standing position and the inclined position is not limited to the configuration shown in FIGS. 6A to 6C, but a known configuration may be adopted. For example, in the configuration shown in FIGS. 4A and 4B, a rubber member may be attached to the right plate 72 and the left plate 73 at the position corresponding to the middle position, and the rubber member may be contacted with pressure by the front plate 74, so that the front plate 74 can be stopped at the middle position.

In the first embodiment, the rear guide 90 supports paper 15 that is supported on the bottom plate 71 (see FIG. 4B). In addition to the rear guide 90, as indicated by the dashed lines in FIG. 4B, the bottom plate 71 may include a protruding portion 102 protruding upward from the upper surface 76. In this case, the protruding portion 102 supports paper 15 supported on the bottom plate 71 in place of the rear guide 90 or in cooperation with the rear guide 90. Note that, in FIG. 4B, the protruding portion 102 and the rear guide 90 support paper 15 in cooperation with each other.

According to this configuration, by supporting paper 15 having a longer front-rear length than the bottom plate 71 by the protruding portion 102, paper 15 supported on the bottom plate 71 can be supported at a higher position. Hence, when paper 15 hangs down in a state where paper 15 having a longer front-rear length than the bottom plate 71 is supported on the bottom plate 71, a possibility that the grip portion 77 is covered by the paper 15 can be reduced.

As shown in FIG. 4B, in a configuration where the protruding portion 102 and the rear guide 90 support paper 15 in cooperation with each other, the protruding portion 102 may be located at a farther forward position than the rear guide 90, and the upper end of the protruding portion 102 may be located at a higher position than the upper end of the rear guide 90.

According to this configuration, in a state where paper 15 having a longer front-rear length than the bottom plate 71 is supported on the bottom plate 71, the paper 15 is supported on the bottom plate 71, the rear guide 90, and the protruding portion 102 in this order from the rear toward the front. Thus, paper 15 can be supported in a natural posture that is gradually upward toward the front.

Figure 9A:
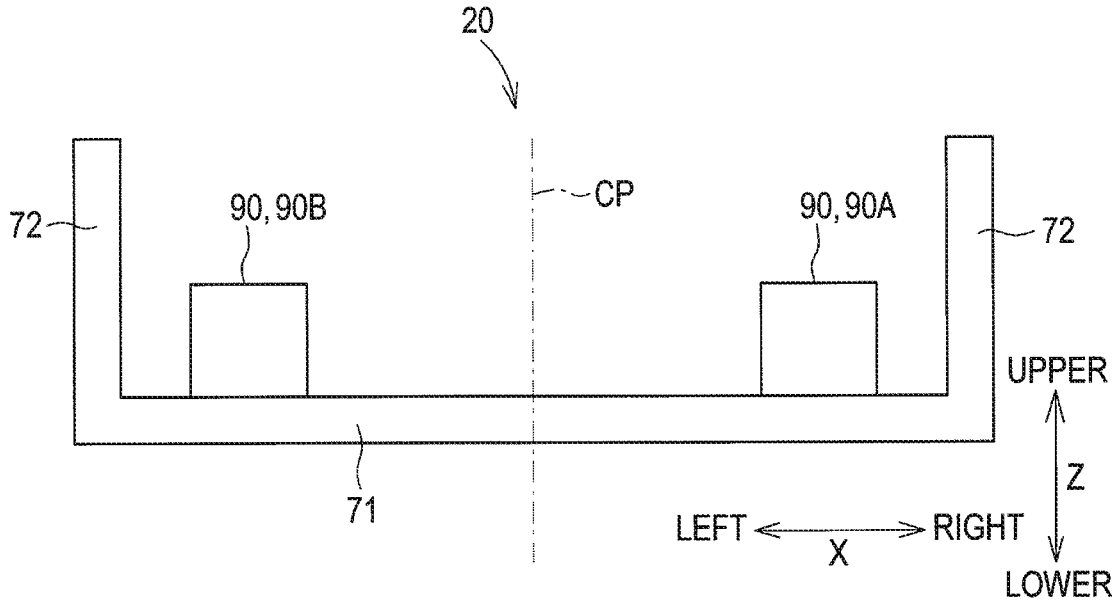
FIGS. 9A and 9B are front views of the feed tray 20 in which the front plate 74 in the modification of the first embodiment is removed.

As shown in FIG. 9A, the rear guide 90 may include two guides of a rear guide 90A (an example of a first protruding portion) and a rear guide 90B (an example of a second protruding portion). The rear guide 90A is located at a farther rightward position than a center position CP of the bottom plate 71 in the left-right direction X. The rear guide 90B is located at a farther leftward position than the center position CP. Alternatively, the rear guide 90A may include a plurality of rear guides, and the rear guide 90B may include a plurality of rear guides. In FIG. 9A, the front plate 74 is not shown for simplicity.

In the configuration shown in FIG. 9A, in a state where the front plate 74 is rotatably moved to the inclined position and paper 15 having a longer front-rear length than the bottom plate 71 is supported on the bottom plate 71, the paper 15 is supported by the rear guides 90A, 90B and becomes a state where the paper 15 is curved to be convex downward when viewed in the front-rear direction Y. This configuration suppresses hanging down of paper 15. As a result, a possibility that the grip portion 77 is covered by hanging paper 15 can be reduced.

Figure 9B:
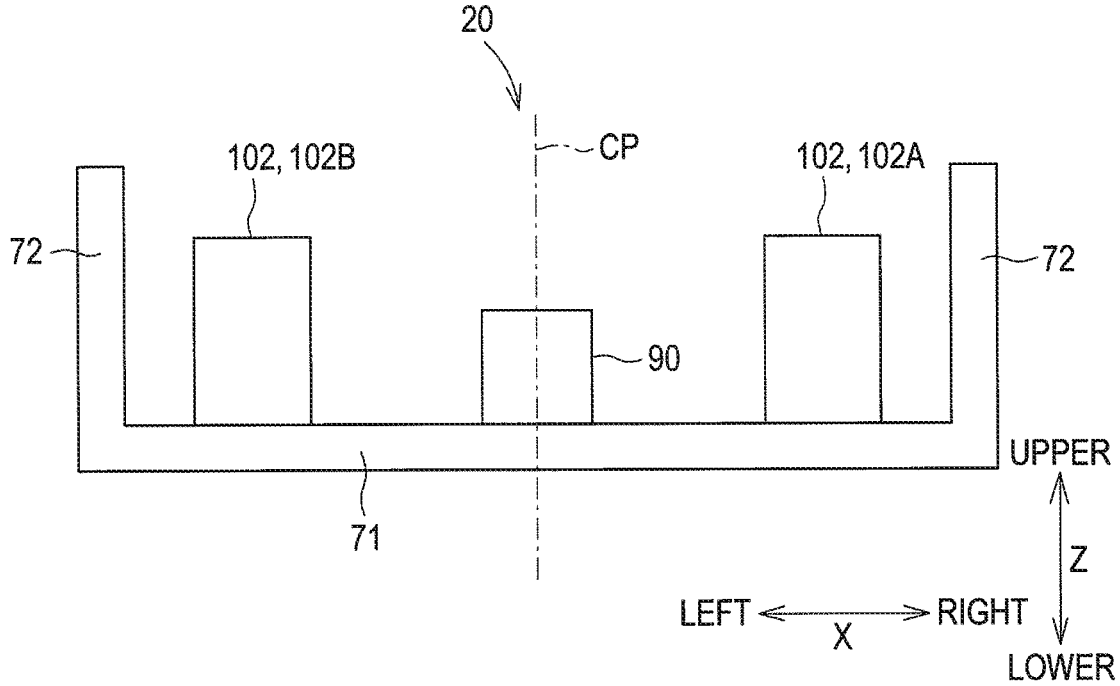

In a configuration where the protruding portion 102 and the rear guide 90 support paper 15 in cooperation with each other, as shown in FIG. 9B, the protruding portion 102 may include two protruding portions of a first protruding portion 102A and a second protruding portion 102B. The first protruding portion 102A is located at a farther rightward position than the center position CP. The second protruding portion 102B is located at a farther leftward position than the center position CP. The rear guide 90 is located between the first protruding portion 102A and the second protruding portion 102B in the left-right direction X. Alternatively, the first protruding portion 102A may include a plurality of protruding portions, and the second protruding portion 102B may include a plurality of protruding portions. In FIG. 9B, the front plate 74 is not shown for simplicity.

In the configuration shown in FIG. 9B, in a state where the front plate 74 is rotatably moved to the inclined position and paper 15 having a longer front-rear length than the bottom plate 71 is supported on the bottom plate 71, the paper 15 is supported by the first protruding portion 102A, the second protruding portion 102B, and the rear guide 90 and becomes a state where the paper 15 is curved to be convex downward when viewed in the front-rear direction Y. This configuration suppresses hanging down of paper 15. As a result, a possibility that the grip portion 77 is covered by hanging paper 15 can be reduced.

Second Embodiment

Hereinafter, a second embodiment will be described while referring to FIGS. 7A, 7B, and 8 wherein like parts and components are designated by the same reference numerals to avoid duplicating description.

Figure 11A:
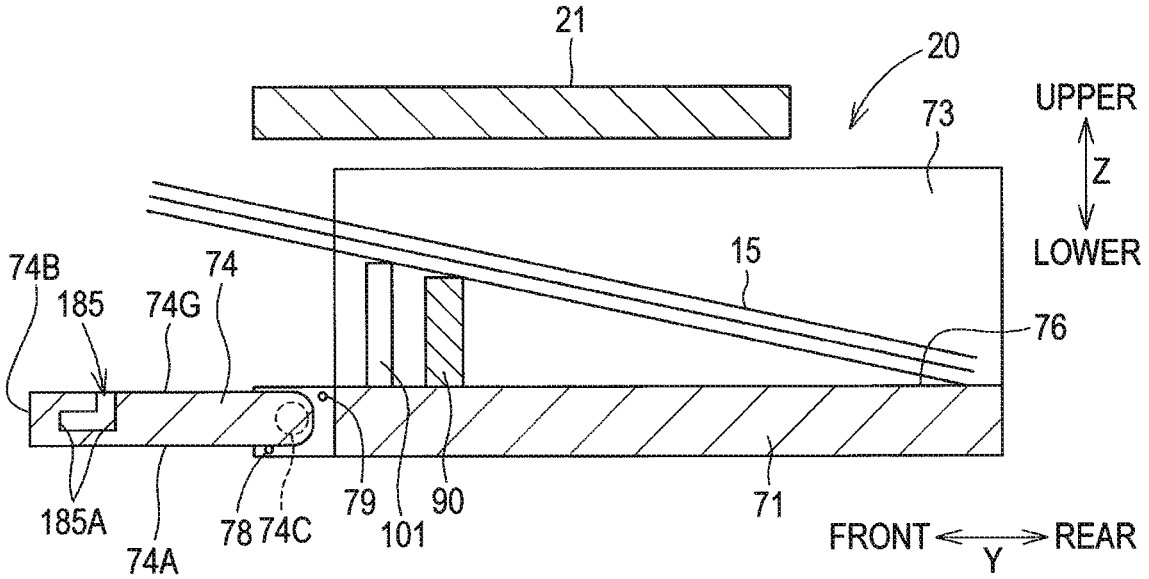
FIG. 11A is a cross-sectional view schematically showing a part of the feed tray 20 having a concave portion 185 and the discharge tray 21 corresponding to the section A-A of FIG. 3 in a state where the front plate 74 is at a lying position.
Figure 11B:
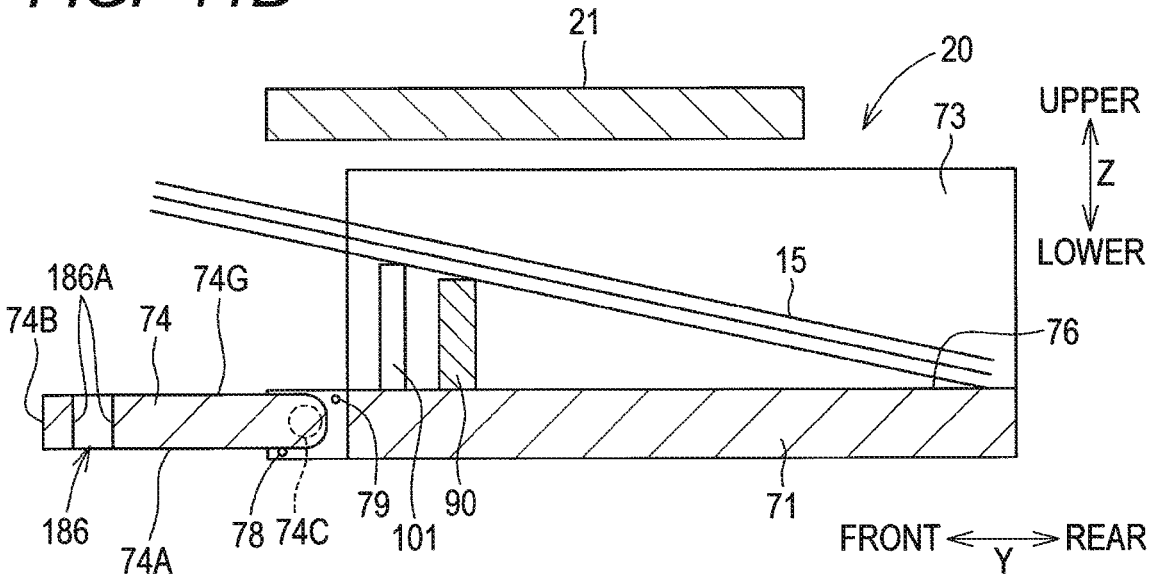
FIG. 11B is a cross-sectional view schematically showing a part of the feed tray 20 having a through hole 186 and the discharge tray 21 corresponding to the section A-A of FIG. 3 in a state where the front plate 74 is at a lying position.

The front plate 74 includes a grip portion 177 at a rear surface 74G thereof. In the second embodiment, the grip portion 177 is a protrusion protruding from the rear surface 74G. In the second embodiment, the grip portion 177 is located at the center portion of the rear surface 74G in the left-right direction X, but may be located at a portion other than the center portion. As shown in FIG. 11A, a concave portion 185 that is concaved forward (in a state where the front plate 74 is at the standing position) may be formed at the rear surface 74G, instead of the protrusion. In this case, each surface 185A constituting (defining) the concave portion 185 serves as the grip. Alternatively, instead of the protrusion, a through hole 186 penetrating the front plate 74 in the front-rear direction Y (in a state where the front plate 74 is at the standing position) may be formed in the front plate 74. In this case, each surface 186A constituting (defining) the through hole 186 serves as the grip. Each of the grip portion 177, the surface 185A defining the concave portion 185, and the surface 186A defining the through hole 186 is an example of the grip. The grip portion 177 is accessible from the upper side of the front plate 74 in a state where the front plate 74 is located at a lying position shown in FIG. 7B (first position).

Figure 7A:
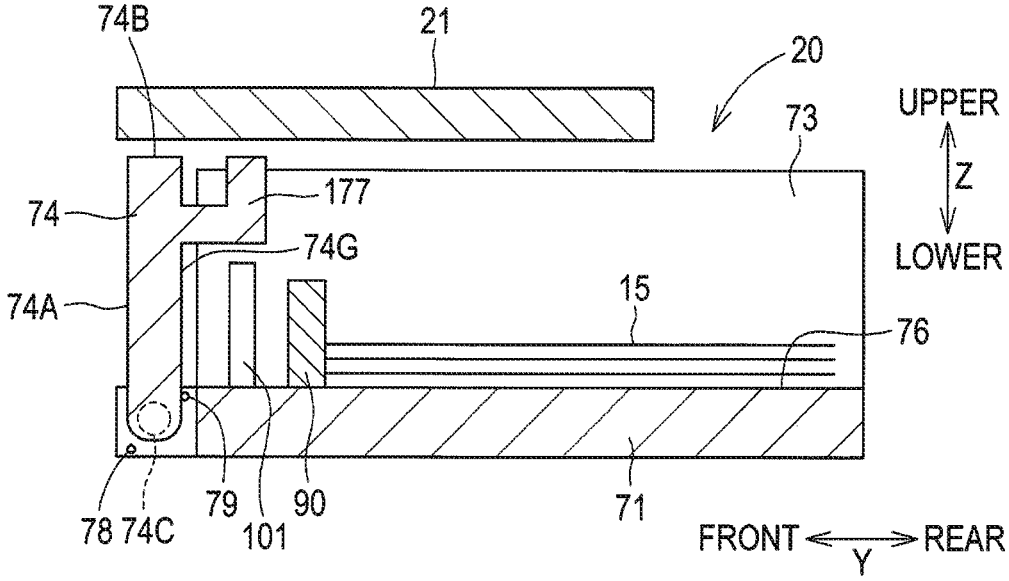
Figure 7B:
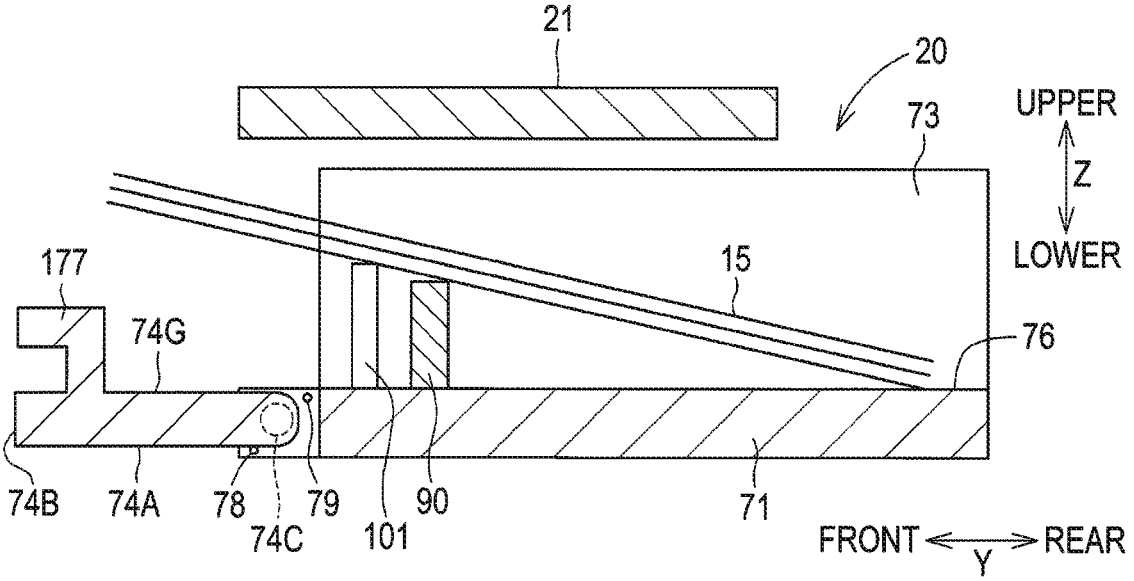

The front plate 74 is configured to rotatably move between a standing position shown in FIG. 7A (an example of the second position) and a lying position shown in FIG. 7B (an example of the first position). As shown in FIGS. 7A and 7B, the front plate 74 may be rotatably supported by the front end portion of the bottom plate 71. Alternatively, the front plate 74 may be rotatably supported by another member (for example, the left and right side plates) at a position adjacent to the front end portion of the bottom plate 71.

The standing position of the front plate 74 in the second embodiment is a position that is similar to the standing position of the front plate 74 in the first embodiment. In a state where the front plate 74 is located at the standing position, the rear surface 74G extends in the upper-lower direction Z and in the left-right direction X and faces rearward.

In the second embodiment, in a state where the front plate 74 is located at the lying position, the front plate 74 extends forward (horizontally) from the front end portion of the bottom plate 71. In the second embodiment, in a state where the front plate 74 is located at the lying position, the rear surface 74G extends in the front-rear direction Y and in the left-right direction X and faces upward. The lying position in the second embodiment is not limited to the position shown in FIG. 7B, and may be a position that is similar to the position in the first embodiment (a position where the front plate 74 is inclined relative to the bottom plate 71), for example.

In the second embodiment, the user grips the right end portion or the left end portion of the front plate 74 at the standing position, so that the front plate 74 is rotatably moved to the lying position. Further, the user accesses, from above, the front plate 74 at the lying position and grips the grip portion 177, so that the front plate 74 is rotatably moved to the standing position.

As shown in FIGS. 7A and 7B, the bottom plate 71 includes a protruding portion 101 protruding upward from the upper surface 76. The protruding portion 101 is located at a farther forward position than the rear guide 90 and is located at a farther rearward position than the front plate 74. The upper end of the protruding portion 101 is located at a higher position than the upper end of the rear guide 90.

Figure 8:
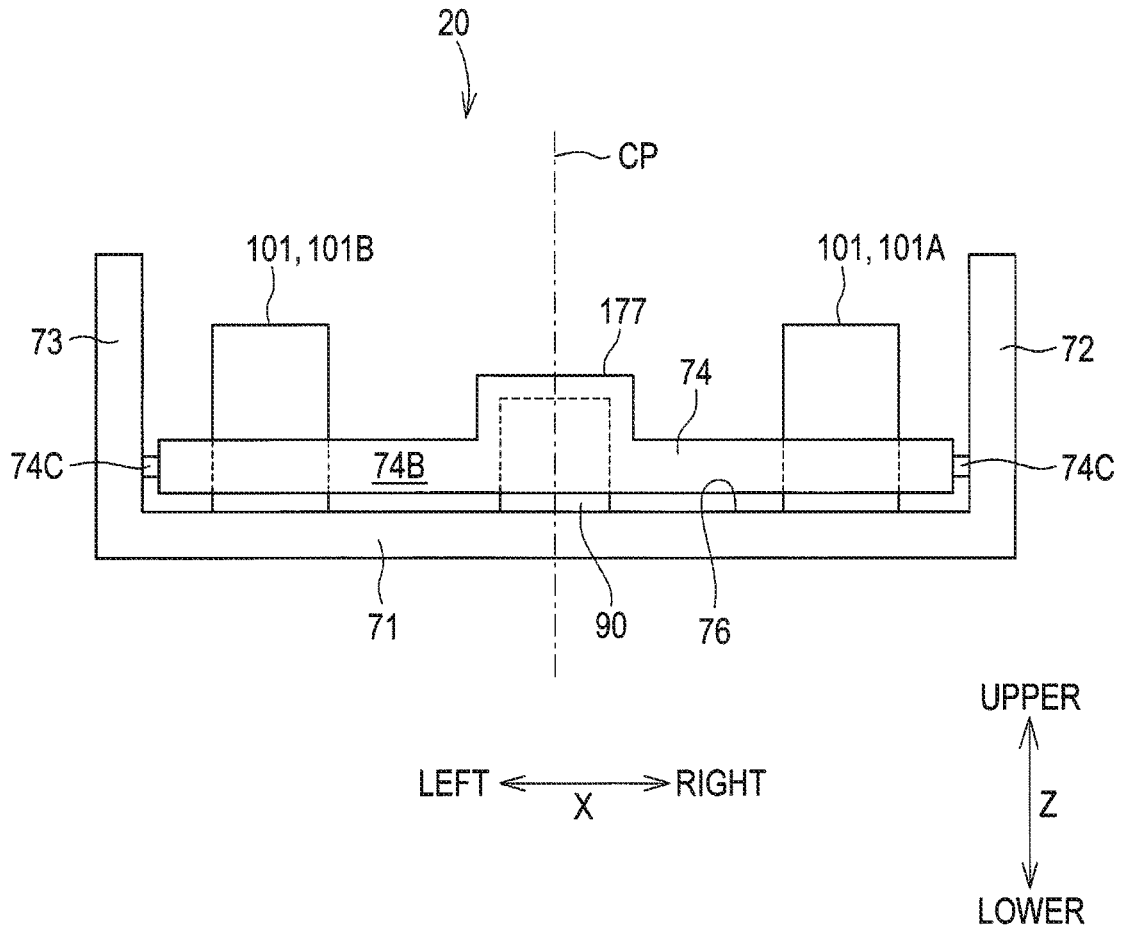
FIG. 8 is a front view of the feed tray 20 of the second embodiment.

As shown in FIG. 8, the protruding portion 101 includes two protruding portions of a first protruding portion 101A and a second protruding portion 101B. The first protruding portion 101A is located at a farther rightward position than a center position CP of the bottom plate 71 in the left-right direction X. The second protruding portion 101B is located at a farther leftward position than the center position CP. The rear guide 90 is located between the first protruding portion 101A and the second protruding portion 101B in the left-right direction X. The first protruding portion 101A may include a plurality of protruding portions, and the second protruding portion 101B may include a plurality of protruding portions.

As shown in FIG. 7A, in a case where paper 15 having a shorter length than the upper surface 76 in the front-rear direction Y is supported on the upper surface 76, the paper 15 is positioned by the rear guide 90. At this time, the front plate 74 is located at the standing position.

As shown in FIG. 7B, in a case where paper 15 having a longer length than the upper surface 76 in the front-rear direction Y is supported on the upper surface 76, the front plate 74 is located at the lying position. At this time, the rear portion of the paper 15 is supported by the upper surface 76, and the front portion of the paper 15 is supported by the protruding portion 101 and the rear guide 90.

At this time, the upper ends of the protruding portions 101 located at both end portions in the left-right direction X are located at higher positions than the upper end of the rear guide 90 located at the center portion in the left-right direction X. Thus, the front portion of the paper 15 becomes convex downward with respect to the left-right direction X. This suppresses hanging down of a portion of the paper 15 located farther forward than the protruding portion 101.

Further, at this time, the upper end of the protruding portion 101 is located at a higher position than the upper end of the grip portion 177. With this configuration, a gap is formed in the upper-lower direction Z between paper 15 supported by the protruding portion 101 and the grip portion 177. Hence, in a state where the front plate 74 is located at the lying position, the grip portion 177 can be gripped easily.

According to the second embodiment, in a case where paper 15 having a longer front-rear length than the bottom plate 71 is supported on the bottom plate 71, the front plate 74 is rotatably moved to the lying position. With this configuration, because the upper end of the front plate 74 at the lying position is located at a lower position than the upper end of the front plate 74 at the standing position, the gap above the front plate 74 (the gap between the front plate 74 and the discharge tray 21 in the second embodiment) can increased. That is, the gap between the housing 14 (specifically, the surface defining the opening) and the upper end of the front plate 74 can be increased. And, paper 15 having a longer front-rear length than the bottom plate 71 can be supported on the bottom plate 71 through this gap.

According to the second embodiment, in a state where the front plate 74 is rotatably moved to the lying position and paper 15 having a longer front-rear length than the bottom plate 71 is supported on the bottom plate 71, the front portion of the paper 15 is supported by the protruding portion 101 and is located at a higher position than the grip portion 177. Thus, the feed tray 20 can be moved easily by gripping the grip portion 177.

According to the second embodiment, in a state where the front plate 74 is rotatably moved to the lying position and paper 15 having a longer front-rear length than the bottom plate 71 is supported on the bottom plate 71, the paper 15 is supported by the first protruding portion 101A and the second protruding portion 101B and becomes a curved state to be convex downward with respect to the left-right direction X. This configuration suppresses hanging down of paper 15. As a result, a possibility that the grip portion 177 is covered by hanging paper 15 can be reduced.

According to the second embodiment, in a state where the front plate 74 is rotatably moved to the lying position and paper 15 having a longer front-rear length than the bottom plate 71 is supported on the bottom plate 71, the paper 15 is supported by the first protruding portion 101A, the second protruding portion 101B, and the rear guide 90 and becomes a curved state to be convex downward with respect to the left-right direction X. This configuration suppresses hanging down of paper 15. As a result, a possibility that the grip portion 177 is covered by hanging paper 15 can be reduced.

According to the second embodiment, in a state where paper 15 having a longer front-rear length than the bottom plate 71 is supported on the bottom plate 71, the paper 15 is supported by the bottom plate 71, the rear guide 90, and the protruding portion 101 in this order toward the front. Here, the upper end of the protruding portion 101 is located at a higher position than the upper end of the rear guide 90, and the upper end of the rear guide 90 is located at a higher position than the bottom plate 71. Thus, paper 15 can be supported in a natural posture that is gradually upward toward the front.

According to the second embodiment, paper 15 having a longer front-rear length than the bottom plate 71 can be supported by the rear guide 90.

[Modification of Second Embodiment]

The protruding portion 101 may be located at the same position as the rear guide 90 in the front-rear direction Y, or may be located at a farther rearward position than the rear guide 90.

The upper end of the protruding portion 101 may be at the same height as or at a lower position than the upper end of the rear guide 90 in the upper-lower direction Z.

The number of the protruding portion 101 is not limited to two, and may be one or three or more.

In the second embodiment, the rear guide 90 is located between two protruding portions 101 (the first protruding portion 101A and the second protruding portion 101B) in the left-right direction X. The positional relationship is not limited to this. For example, both of the first protruding portion 101A and the second protruding portion 101B may be located at a farther leftward position than the rear guide 90. Further, for example, in a configuration where only one protruding portion 101 is provided, the protruding portion 101 and the rear guide 90 may be located at the same position in the left-right direction X. Further, for example, in a configuration where three protruding portions 101 are provided, one protruding portion 101 may be located at a farther rightward position than the rear guide 90, one protruding portion 101 may be located at a farther leftward position than the rear guide 90, and the other protruding portion 101 may be located at the same positon as the rear guide 90 in the left-right direction X.

The feed tray 20 in the second embodiment may not include the protruding portion 101.

[Modification of First and Second Embodiments]

In the first and second embodiments, the recording unit 24 records an image on paper 15 by an inkjet method. Alternatively, the recording unit may record an image on paper 15 by a method other than the inkjet method, for example, by an electro-photographic method.

In the first and second embodiments, the sheet feed device is provided at the MFP 10. However, an apparatus including the sheet feed device is not limited to the MFP 10. For example, the sheet feed device may be provided at a printer, a facsimile machine, a scanner, and so on.

While the disclosure has been described in detail with reference to the above aspects thereof, it would be apparent to those skilled in the art that various changes and modifications may be made therein without departing from the scope of the claims.

What is claimed is:

1. A sheet feed device comprising:

a housing having an opening and a sheet conveyance path; and a tray configured to be inserted into the housing through the opening in a first direction and to be pulled out from the housing in a second direction opposite from the first direction, the tray being configured to support a sheet, the tray including:

a bottom plate configured to support a sheet; and a front plate rotatably supported at an end portion of the tray in the second direction, the front plate having a first end portion at which a rotational axis of the front plate is located and a second end portion opposite from the first end portion, the front plate being configured to rotatably move between:

a first position at which the front plate extends diagonally upward in the second direction from the first end portion toward the second end portion; and a second position at which the second end portion of the front plate is located at a position that is higher than the second end portion at the first position and that is shifted in the first direction from the second end portion at the first position, the front plate including a grip and a surface, the surface of the front plate facing in the second direction and downward in a state where the front plate is located at the first position, wherein the surface surrounds the grip.

2. The sheet feed device according to claim 1, wherein the grip protrudes from the surface of the front plate.

3. The sheet feed device according to claim 1, wherein the grip includes a surface defining a concave portion that is formed in the surface of the front plate.

4. The sheet feed device according to claim 1, wherein the grip includes a surface defining a through hole that is formed to penetrate the front plate.

5. The sheet feed device according to claim 1, wherein both end portions of an upper surface of the front plate in a width direction are located at higher positions than a center portion of the front plate in the width direction, the width direction being perpendicular to the first direction and being parallel to a sheet support surface of the bottom plate.

6. The sheet feed device according to claim 1, wherein the tray includes a pair of side plates protruding upward from both end portions of the bottom plate in a width direction, the width direction being perpendicular to the first direction and being parallel to a sheet support surface of the bottom plate;

wherein the sheet feed device further comprises a protrusion provided at one of the front plate and the pair of side plates, the protrusion protruding in the width direction toward an other one of the front plate and the pair of side plates;

wherein the other one of the front plate and the pair of side plates is formed with a first groove, a second groove, and a third groove in which the protrusion is inserted and guided;

wherein, in a state where the protrusion is located at one end of the first groove, the front plate is located at the first position;

wherein, in a state where the protrusion is located at an other end of the first groove, the front plate is located at a third position between the first position and the second position;

wherein, in a state where the protrusion is located at one end of the second groove, the front plate is located at the second position;

wherein one end of the third groove is connected to a part of the first groove between the one end and the other end; and wherein an other end of the third groove is connected to an other end of the second groove.

7. The sheet feed device according to claim 1, further comprising a protruding portion protruding upward from the bottom plate at a position shifted in the first direction from the front plate.

8. The sheet feed device according to claim 7, wherein the protruding portion includes:

a first protruding portion disposed at one side of a center of the bottom plate in a width direction, the width direction being perpendicular to the first direction and being parallel to a sheet support surface of the bottom plate; and a second protruding portion disposed at another side of the center of the bottom plate in the width direction.

9. The sheet feed device according to claim 8, further comprising a rear guide provided at the bottom plate, the rear guide being configured to contact an end of a sheet in the second direction that is supported on the bottom plate;

wherein the rear guide is located between the first protruding portion and the second protruding portion in the width direction; and wherein an upper end of the first protruding portion and an upper end of the second protruding portion are located at higher positions than an upper end of the rear guide.

10. The sheet feed device according to claim 7, further comprising a rear guide provided at the bottom plate, the rear guide being configured to contact an end of a sheet in the second direction that is supported on the bottom plate;

wherein the protruding portion is located at a position shifted from the rear guide in the second direction; and wherein an upper end of the protruding portion is located at a higher position than an upper end of the rear guide.

11. The sheet feed device according to claim 7, wherein the protruding portion serves as a rear guide configured to contact an end of a sheet in the second direction supported on the bottom plate.

12. A sheet feed device comprising:

a housing having an opening and a sheet conveyance path; and a tray configured to be inserted into the housing through the opening in a first direction and to be pulled out from the housing in a second direction opposite from the first direction, the tray being configured to support a sheet, the tray including:

a bottom plate configured to support a sheet;

a front plate rotatably supported at an end portion of the tray in the second direction, the front plate having a first end portion at which a rotational axis of the front plate is located and a second end portion opposite from the first end portion; and a protruding portion protruding upward from the bottom plate at a position shifted from the front plate in the first direction, the front plate being configured to rotatably move between:

a first position at which the front plate extends from the first end portion toward the second end portion in a direction having a component along the second direction; and a second position at which the second end portion of the front plate is located at a position that is higher than the second end portion at the first position, the front plate including a grip and a surface, the surface of the front plate facing upward in a state where the front plate is located at the first position, wherein the surface surrounds the grip, in a state where the front plate is located at the first position, an upper end of the protruding portion is located at a higher position than an upper end of the grip.

13. The sheet feed device according to claim 12, wherein the grip protrudes from the surface of the front plate.

14. The sheet feed device according to claim 12, wherein the grip includes a surface defining a concave portion that is formed in the surface of the front plate.

15. The sheet feed device according to claim 12, wherein the grip includes a surface defining a through hole that is formed to penetrate the front plate.

16. The sheet feed device according to claim 12, wherein the protruding portion includes:

a first protruding portion disposed at one side of a center of the bottom plate in a width direction, the width direction being perpendicular to the first direction and being parallel to a sheet support surface of the bottom plate; and a second protruding portion disposed at another side of the center of the bottom plate in the width direction.

17. The sheet feed device according to claim 16, further comprising a rear guide provided at the bottom plate, the rear guide being configured to contact an end of a sheet in the second direction that is supported on the bottom plate;

wherein the rear guide is located between the first protruding portion and the second protruding portion in the width direction; and wherein an upper end of the first protruding portion and an upper end of the second protruding portion are located at higher positions than an upper end of the rear guide.

18. The sheet feed device according to claim 17, further comprising a rear guide provided at the bottom plate, the rear guide being configured to contact an end of a sheet in the second direction that is supported on the bottom plate;

wherein the protruding portion is located at a position shifted from the rear guide in the second direction; and wherein an upper end of the protruding portion is located at a higher position than an upper end of the rear guide.

19. The sheet feed device according to claim 16, wherein the protruding portion serves as a rear guide configured to contact an end of a sheet in the second direction supported on the bottom plate.

20. The sheet feed device according to claim 12, wherein, in a state where the front plate is located at the first position, the front plate extends horizontally from the bottom plate in the second direction.

* * * * *